US007070691B2

(12) United States Patent
Lindemulder

(10) Patent No.: US 7,070,691 B2
(45) Date of Patent: Jul. 4, 2006

(54) PROTECTOR FOR SEWER SYSTEM INLET

(75) Inventor: Jim Lindemulder, Calgary (CA)

(73) Assignee: BMP Supplies Inc., Calgary (CA)

( * ) Notice: Subject to any disclaimer, the term of this patent is extended or adjusted under 35 U.S.C. 154(b) by 98 days.

(21) Appl. No.: 10/724,069

(22) Filed: Dec. 1, 2003

(65) Prior Publication Data

US 2004/0112811 A1 Jun. 17, 2004

(51) Int. Cl.
*E03F 5/06* (2006.01)

(52) U.S. Cl. ..... 210/164; 210/474; 404/4

(58) Field of Classification Search ..... 210/162, 210/163, 164, 254, 474, 489; 404/4, 5
See application file for complete search history.

(56) References Cited

U.S. PATENT DOCUMENTS 5,372,714 A * 12/1994 Logue, Jr. ..... 210/164
5,632,888 A * 5/1997 Chinn et al. ..... 210/163
5,954,952 A * 9/1999 Strawser, Sr. ..... 210/164
6,214,216 B1 * 4/2001 Isaacson ..... 210/162
6,261,445 B1 * 7/2001 Singleton ..... 210/163
6,274,036 B1 * 8/2001 Ellis ..... 210/164
6,805,804 B1 * 10/2004 Page ..... 210/164
2002/0104789 A1 * 8/2002 Harris et al. ..... 210/162
2002/0130083 A1 * 9/2002 Middleton et al. ..... 210/163

* cited by examiner

*Primary Examiner*—Christopher Upton
(74) *Attorney, Agent, or Firm*—George A. Seaby

(57) ABSTRACT

A protector for the inlet into a sewer system includes a straight or annular, porous tubular casing for placing on or around the periphery of a sewer grate; a skirt extending inwardly or outwardly from the bottom of the casing for overlapping the side edges of a sewer opening so the grate retains the protector in the use position; and a filler in the casing for maintaining the casing in an expanded condition, at least one of the casing, the skirt and the filler being permeable to water and impermeable to contaminants, whereby water can flow into the system while contaminants are blocked.

6 Claims, 5 Drawing Sheets

PROTECTOR FOR SEWER SYSTEM INLET

BACKGROUND OF THE INVENTION

1. Field of the Invention

This invention relates to a protector for an inlet to a sewer system.

More specifically, the invention relates to a protector, which permits the flow of water into a sewer system while preventing the flow of silt, oil, tar and other contaminants into the system.

2. Discussion of the Prior Art

When constructing new subdivisions, some of the first steps are to build roads and to install sewer systems. There is a lot of traffic into and out of a building project, and when it rains, vehicles carry large quantities of mud and other contaminants onto existing roadways. As a result large quantities of polluting contaminants get washed into sewer systems. A need exists for a solution to this pollution problem.

Bags and other devices for preventing the entry of contaminants into catch basins and other parts of sewer systems are disclosed by Canadian Patent No. 2,143,984, issued to J. E. Hutter Jr. et al on May 16, 2000, Canadian Patent Application No. 2,226,474, published in the name of J. B. Lamb on Jul. 8, 1998, and U.S. Pat. No. 5,345,741, issued to H. O. Slater on Sep. 13, 1994; U.S. Pat. No. 5,632,888, issued to A. W. Chinn et al on May 27, 1997; U.S. Pat. No. 5,743,674, issued to P. E. Healy on Apr. 28, 1998; U.S. Pat. No. 5,948,250, issued to D. G. Middleton on Sep. 7, 1999; U.S. Pat. No. 6,010,622, issued to A. W. Chinn et al on Jan. 4, 2000; U.S. Pat. No. 6,059,964, issued to D. M. Strawser Sr. on May 9, 2000 and U.S. Pat. No. 6,274,036, issued to D. Ellis on Aug. 14, 2000.

Some of the devices described in the above-listed references are in the form of filter bags for removable mounting in a catch basin opening. Thus, they require some form of mounting system, and consequently would be expensive to produce, somewhat difficult to install and dangerous to remove. Others of the devices are intended for above ground use, i.e. for mounting on top of a grate or sewer cover, and one system is in the form of an envelope for receiving a sewer cover which would quickly become clogged when sediment laden water enters the sewer system, and is not adapted to handle overflow or storm water. Moreover, many existing apparatuses are ill-suited to above ground use. When trucks and other heavy equipment are constantly moving over an area, there is a good chance that the sewer protecting apparatus will get run over. When this occurs, the apparatus will be destroyed, severely damaged and/or moved out of position over the sewer grate on which it is mounted.

GENERAL DESCRIPTION OF THE INVENTION

A need still exists for a durable, effective and easy to install protector for sewer systems. The object of the present invention is to meet such need by providing a relatively simple protector for the inlet to a sewer system which can be installed quickly, which will remain in place even when subjected to heavy vertical and horizontal forces, and which is adapted to handle overflow in the event of a heavy rainfall.

Accordingly, the invention relates to a protector for an inlet to a sewer system, which includes a grate over an opening into the system, comprising a closed, porous, tubular casing for placing on or around the periphery of a sewer inlet opening; a skirt connected to said casing for overlapping side edges of a sewer inlet opening and for retaining the protector in position when a grate is placed over the opening to engage the skirt; and a filler in the casing for maintaining the top of the casing in an expanded condition so that the casing can act as a barrier, at least one of the casing, skirt and the filler being permeable to water and impermeable to silt, oil, tar and other contaminants, whereby the protector permits the flow of water while blocking the flow of contaminants into a sewer.

BRIEF DESCRIPTION OF THE DRAWINGS

The invention is described below in greater detail with reference to the accompanying drawings wherein.

DESCRIPTION OF THE PREFERRED EMBODIMENT

Figure 1:
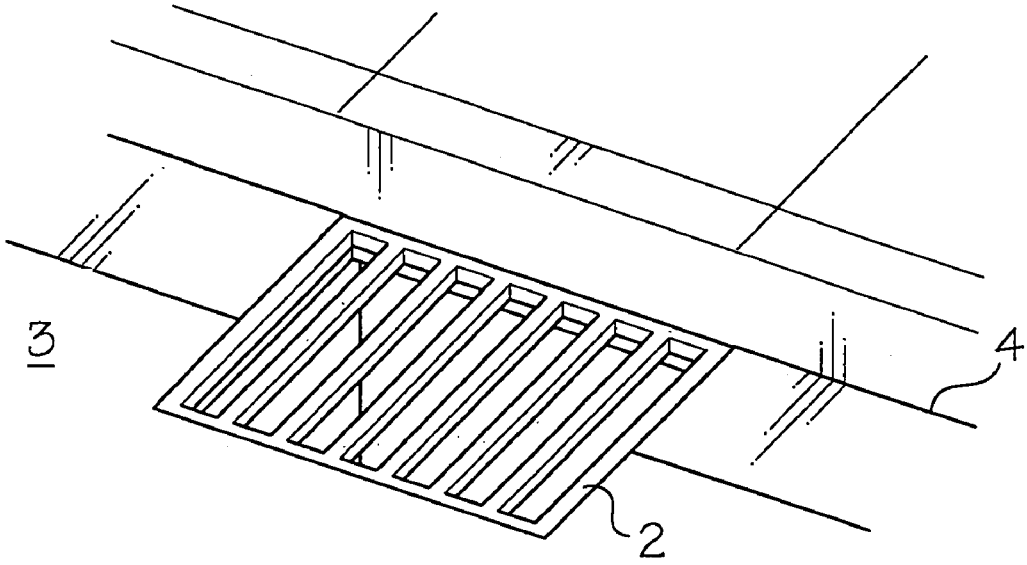
FIGS. 1 and 2 are schematic, isometric views of an inlet to a sewer system in the closed and open conditions, respectively.
Figure 2:
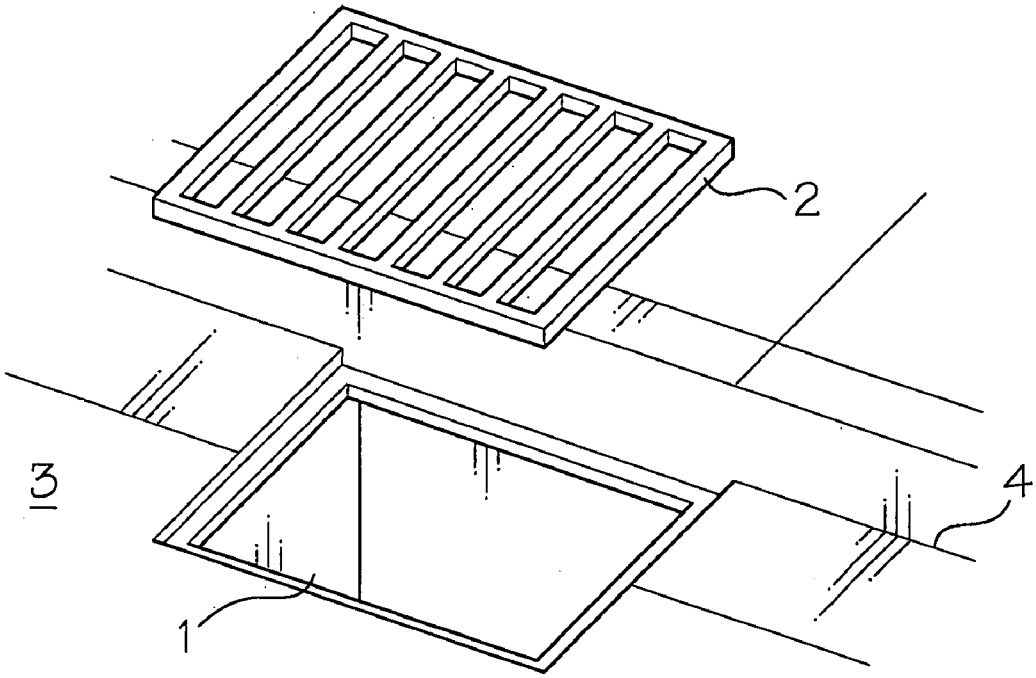

Referring to FIGS. 1 and 2, the protector of the present invention is intended for use in preventing the flow of contaminants into the opening or inlet 1 into a sewer system which is normally closed by a metal grate 2. Usually, such inlets are located on the side of a roadway 3 adjacent to or overlapping a curb 4. In order to install the protector of the present invention, the grate 2 is lifted from the sewer inlet 1 (FIGS. 2 and 3).

Figure 3:
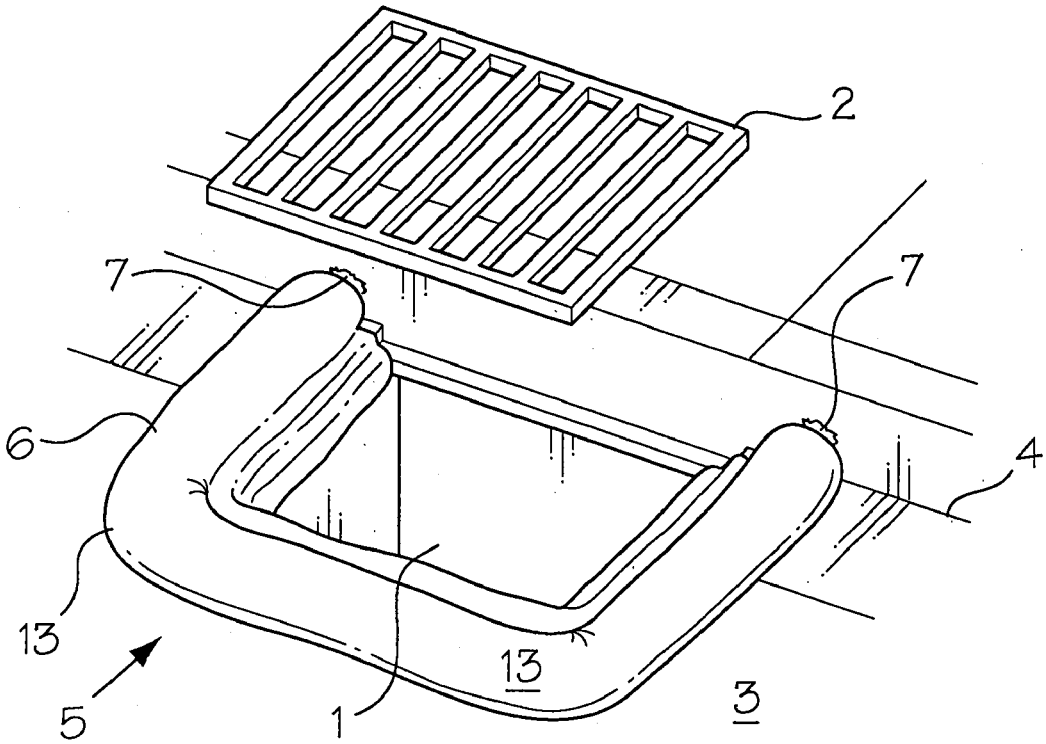
FIGS. 3 and 4 are schematic isometric views of the sewer system of FIGS. 1 and 2 illustrating the installation of a protector in accordance with the invention.
Figure 4:
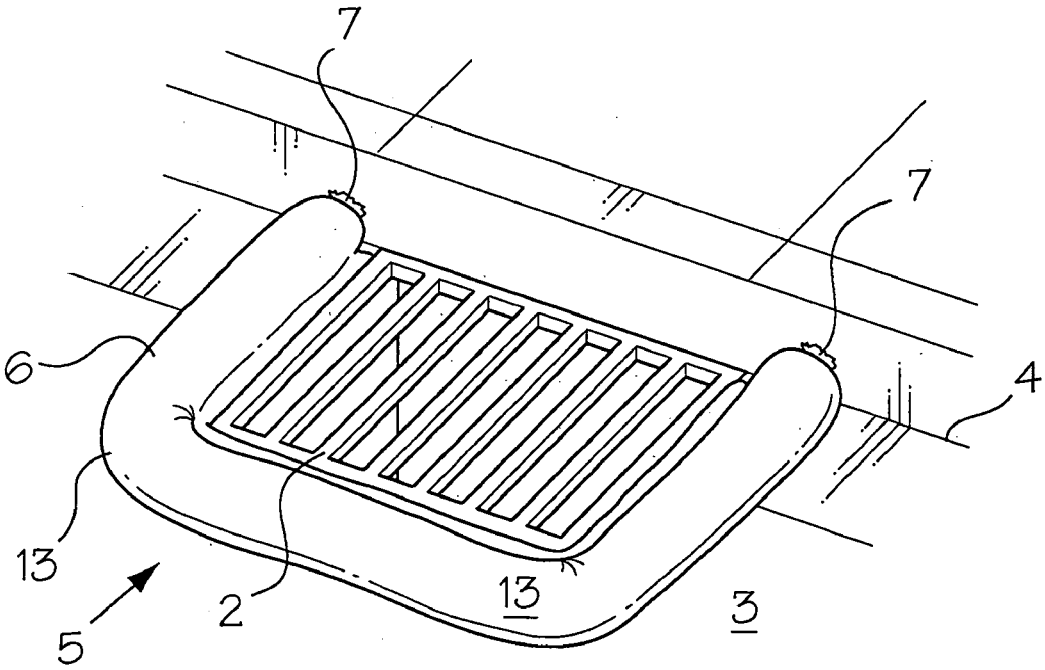

As shown in FIGS. 3 and 4, the protector, which is indicated generally at 5, is defined by a sausage-like tubular casing 6 for placing around the periphery of the sewer opening 1. The casing 6 is formed of a material which is porous to water, but impermeable to oil, tar, gravel, sand and other contaminants. Suitable casing materials include plastics such as polyethylene and polyesters, burlap and tarpaulin. Preferably, the casing 6 is brightly colored, e.g. a bright orange HDPE, so that it is readily visible to vehicle operators. The ends 7 of the casing 6 are sewn or tied closed using lengths of cord or wire (not shown), ultraviolet light resistant, high density polyethylene (HDPE) being preferred.

The casing 6 is filled with a particulate, non-biodegradable material such as small stones, plastic or rubber chips, straw, peat moss, coconut fiber, wood chips, sawdust or wood shavings, kiln dried wood shavings being preferred. Kiln dried wood shavings are inexpensive and readily available in most of North America. Particulate polypropylene is also a good fill material for the casing. When the filler is used to filter contaminants, the casing 6 can be permeable to water and contaminants.

The particle size of the casing filler is not critical. However, if the particle size is too large, contaminent laden water passes through the filler. If the particles are too small, e.g. fine sawdust, the filler seeps through the casing 6 and the filler plugs up or clogs the pores in the casing 6 too quickly when contaminants containing water passes through the casing.

A skirt 9 defined by a strip of flexible material extends outwardly from the bottom of the casing 6 along the length thereof. The skirt 9 can be integral with the casing 6 or attached to the casing following formation thereof. The easiest method of producing the casing and skirt is to form a hollow cylinder from a strip of material with one side of the strip extending outwardly from one side of the bottom of the casing. One end of the cylinder is closed, the cylinder is filled with particulate material, and then the other end of the sleeve is closed.

As best shown in FIGS. 3 and 4, after the sewer inlet grate 2 is removed, the casing 6 is placed around the periphery of the opening 1, except on the curb side thereof at the edge of the sidewalk, with the skirt 9 hanging into the sewer opening. The grate 2 is replaced on top of the skirt 9 which results in securing of the casing 6 in position. Even when a truck or other vehicle drives over the casing 6, the protector remains in position. The permeable casing and the particulate filler material therein permit the flow of water through the casing and into the sewer, while stopping contaminants in the water.

Figure 5:
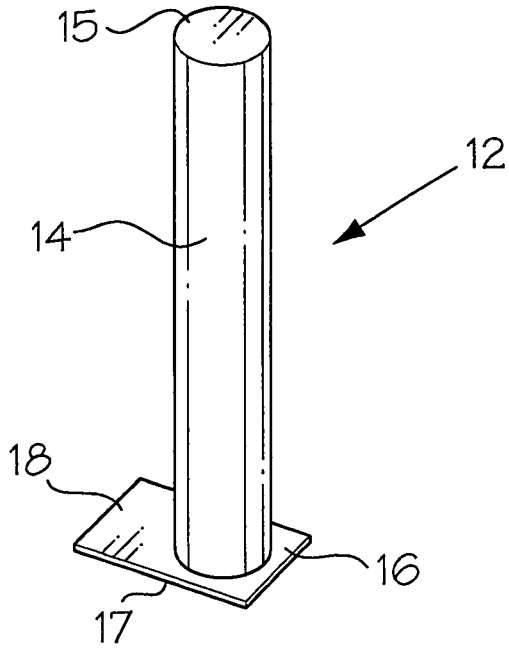
FIG. 5 is an isometric view of a marker pole used with the protector of FIGS. 3 and 4.
Figure 6:
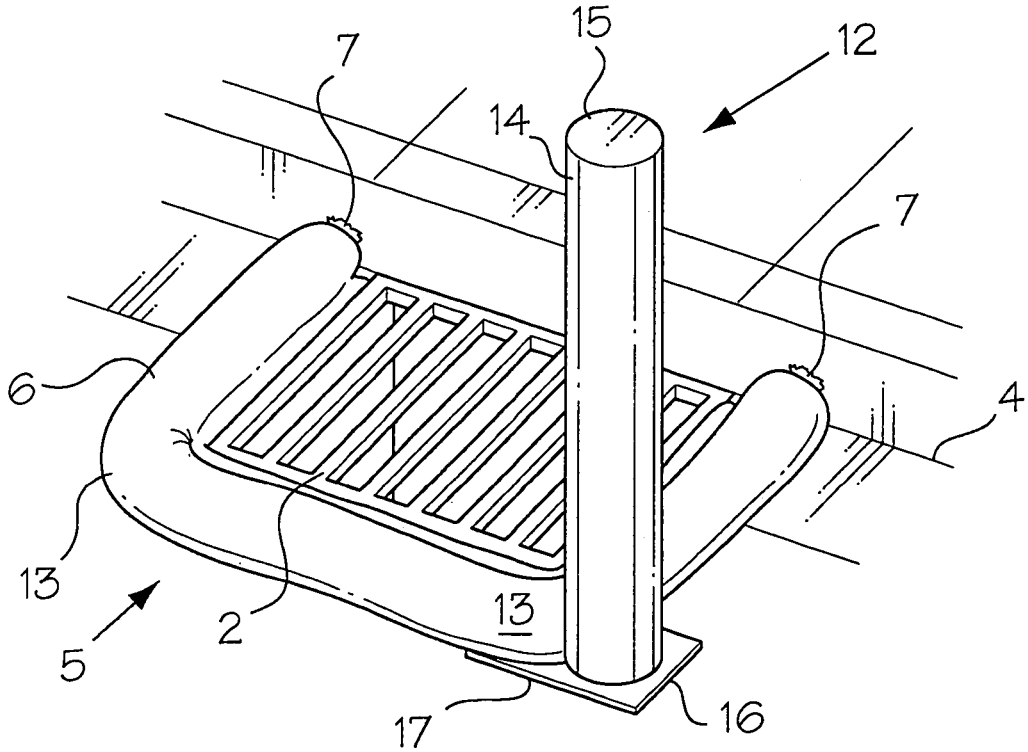
FIG. 6 is an isometric view of the pole of FIG. 5 in the use position with the protector of FIGS. 3 and 4.
Figure 7:
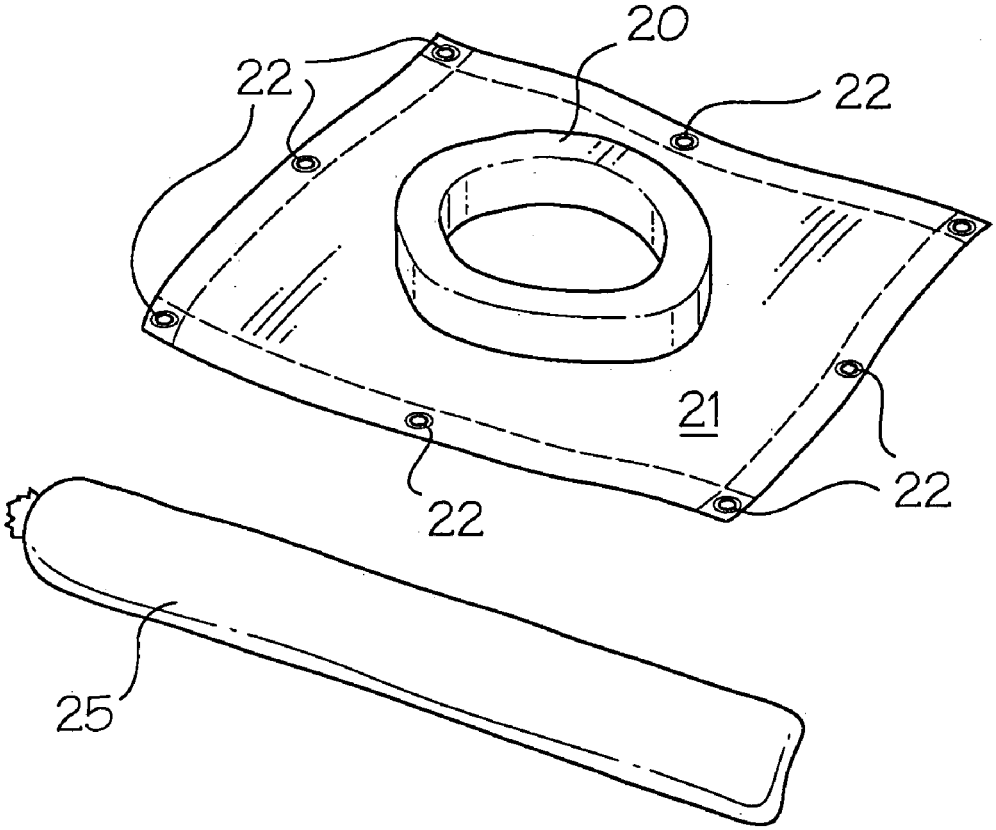
FIG. 7 is a top isometric view of a second embodiment of the protector of the present invention.

Referring to FIGS. 5 and 6, a marker pole indicated generally at 12 is used to indicate the location of one or both outer corners 13 of the casing 16. The pole 12 includes a post 14 with a closed top end 15 mounted on one end 16 of a baseplate 17. Preferably, the post 14 is brightly colored to increase visibility thereof. In use, the other end 18 of the base plate 17 is inserted beneath one corner 13 of the casing 6 which holds the pole in position.

Referring to FIGS. 7 to 10, a second embodiment of the sewer inlet protector includes an annular casing 20 mounted on a skirt 21 defined by a rectangular sheet of HDPE which is permeable to water, but impermeable to contaminants. The casing 20 and its filler (not shown) can be permeable or impermeable to water, i.e. the casing 20 can function in the same manner as the casing 6 (FIGS. 3 and 4) or act as a dam. The filler used in the casing 20 should be resilient, so that it bounces back when subjected to a compressive load, i.e. by a truck or other vehicle.

The skirt 21 can also be a so-called geotextile or geomembrane such as a woven polypropylene fabric available from Amoco Fabrics and Fibers Company under the trade-mark Prolex 2006. According to the manufacturer, such fabrics are stabilized to resist degrading due to UV exposure, resistant to common soil chemicals, mildew and insects, and is non-biodegradable.

Figure 8:
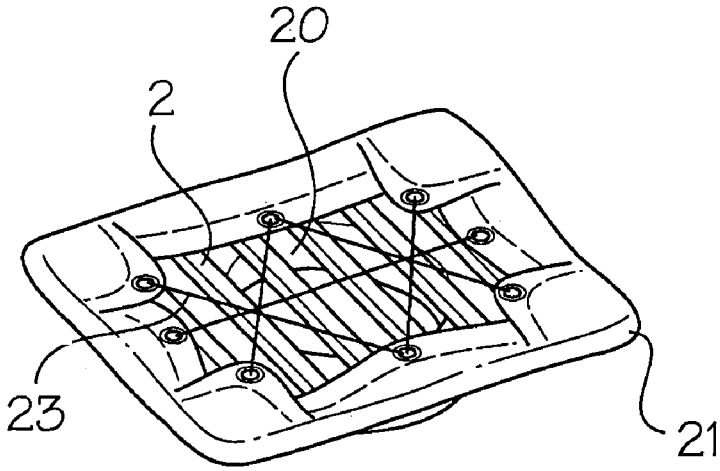
FIG. 8 is a bottom isometric view of a sewer grate with the protector of FIG. 7 mounted thereon.
Figure 9:
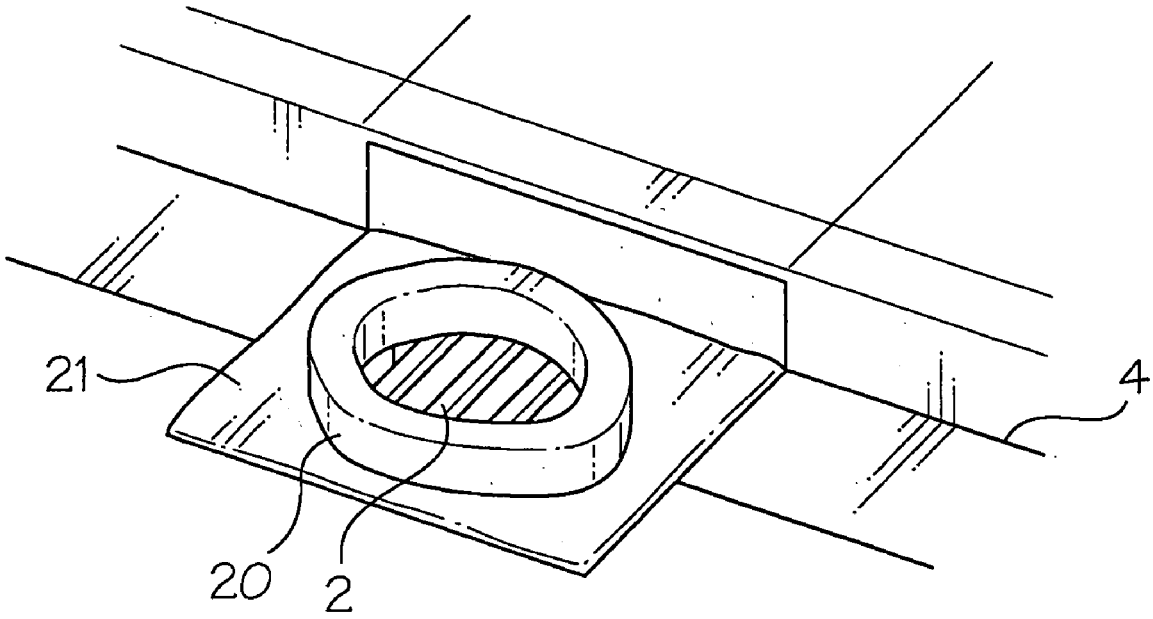
FIGS. 9 and 10 are top isometric views of the protector of FIGS. 7 and 8 in the use position.
Figure 10:
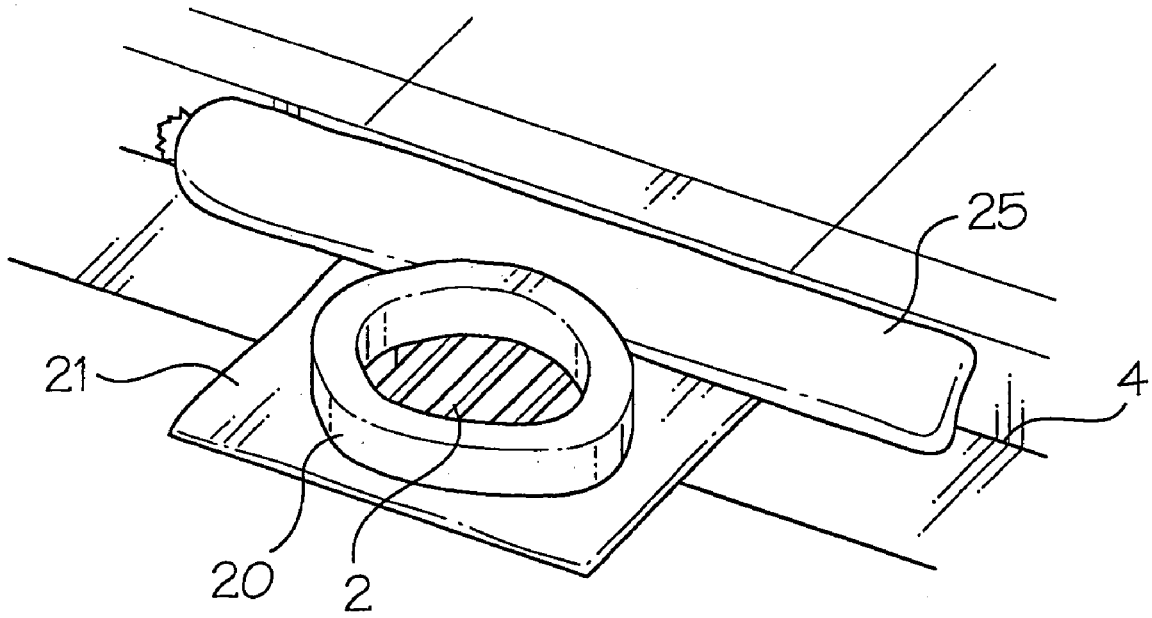

The casing 20 surrounds a hole in the center of the skirt 21. Grommets 22 are provided at the corners and the centers of the sides of the skirt 21 for receiving a cord 23. As shown in FIG. 8, when the skirt 21 is wrapped around a sewer grate 2, the sides of the skirt overlap the bottom side edges of the grate, leaving a large central opening beneath the opening in the casing 20. The cord 23 is threaded through the grommets 22, and its ends are tied together to secure the protector to the grate 2. As shown in FIG. 9, in use, the protector is mounted on a sewer grate 2, and the grate is replaced over the sewer inlet. The skirt is sandwiched between the grate 2 and the ledge on which the grate is mounted. It will be appreciated that the cord 23 can be omitted, in which case the skirt is tucked under the grate 2. However, the use of a cord 23 is preferred.

When the protector of FIGS. 7 to 10 is used on a sewer opening which extends vertically into the curb 4 (FIG. 9), an elongated cylindrical bag 25 is provided for closing the opening in the curb 4. The bag 25 is formed of the same material as the casing 6, and contains the same particulate material (not shown) for filtering water. Of course, the bag 25 and its contents could be impermeable, so that any water entering the sewer is filtered by the casing 20 and the skirt 21. The bag 25 can also be used with the embodiment of the invention illustrated in FIGS. 3 and 4.

It will be appreciated that while the protector, as illustrated, is intended for use with a rectangular sewer opening, the protector can be used equally well with circular sewer openings. The skirt can be circular and/or notched to facilitate folding over the side edges of a sewer opening or for wrapping around the edges of a cover. The use of a skirt ensures that the protector remains in position even when subjected to a load such as a vehicle.

I claim:

1. A protector for an inlet to a sewer system, which includes a grate over an opening into the system, comprising an annular, closed, porous, tubular casing for placing on the grate over the opening; a skirt connected to and extending radially outwardly from a bottom side edge of said casing for wrapping around side edges of the grate and for retaining the protector in position when the grate is placed over the opening to engage the skirt; and a filler in the casing for maintaining the top of the casing in an expanded condition so that the casing can act as a barrier, at least one of the casing, the skirt and the filler being permeable to water and impermeable to silt, oil, tar and other contaminants, whereby the protector permits the flow of water while blocking the flow of contaminants into a sewer.

2. The protector of claim 1, wherein said casing is formed of a fabric selected from the group consisting of polyethylene, polyester, burlap and tarpaulin.

3. The protector of claim 2, wherein the filler is selected from the group consisting of stones, rubber chips, straw, peat moss, coconut fiber, wood chips, sawdust, wood shavings and particulate polypropylene.

4. The protector of claim 1, including grommets in side edges of said skirt, and a cord for threading through said grommets when the skirt is wrapped around a sewer grate to secure the protector on the grate.

5. The protector of claim 4, wherein the casing and the filer therein are impermeable to water and contaminants, and said filler is resilient, whereby the casing and filler rebound when subjected to a compressive load.

6. The protector of claim 4, wherein both the casing and the filler therein are permeable to water and impermeable to contaminants.

* * * * *